US008310175B2

(12) United States Patent
Van Endert

(10) Patent No.: US 8,310,175 B2
(45) Date of Patent: Nov. 13, 2012

(54) MODULAR LAMP SYSTEM

(75) Inventor: Tony Petrus Van Endert, Taipei (TW)

(73) Assignee: Lite-On It Corporation, Taipei (TW)

( * ) Notice: Subject to any disclaimer, the term of this patent is extended or adjusted under 35 U.S.C. 154(b) by 439 days.

(21) Appl. No.: 12/743,289

(22) PCT Filed: May 28, 2008

(86) PCT No.: PCT/CN2008/001043

§ 371 (c)(1),
(2), (4) Date: May 17, 2010

(87) PCT Pub. No.: WO2009/143650

PCT Pub. Date: Dec. 3, 2009

(65) Prior Publication Data

US 2010/0244692 A1 Sep. 30, 2010

(51) Int. Cl.
*H05B 37/00* (2006.01)

(52) U.S. Cl. ..... 315/318; 315/312; 315/86; 362/249.02; 362/311.02; 362/20; 257/99

(58) Field of Classification Search ..... 362/249.02, 362/223, 311.02, 800, 20, 276; 315/32, 34, 315/86, 312, 318; 257/95, 99, 98
See application file for complete search history.

(56) References Cited

U.S. PATENT DOCUMENTS

| | | | | |
|---|---|---|---|---|
| 8,096,683 | B1 * | 1/2012 | Burrell, IV | 362/249.02 |
| 8,100,545 | B2 * | 1/2012 | Dupre et al. | 362/20 |

FOREIGN PATENT DOCUMENTS

| | | | |
|---|---|---|---|
| CN | 2560816 | Y | 7/2003 |
| CN | 2599384 | Y | 1/2004 |
| CN | 201025335 | Y | 2/2008 |
| CN | 201047512 | Y | 4/2008 |
| CN | 201053592 | Y | 4/2008 |
| DE | 20319292 | U1 | 4/2004 |
| DE | 202007001243 | U1 | 6/2007 |
| FR | 2859270 | A1 | 3/2005 |
| WO | 2007069130 | A2 | 6/2007 |

OTHER PUBLICATIONS

International Search Report and Written Opinion dated Feb. 22, 2009.

* cited by examiner

*Primary Examiner* — Haiss Philogene
(74) *Attorney, Agent, or Firm* — McClure, Qualey & Rodack, LLP

(57) ABSTRACT

Modular lamp system comprises a base unit comprising a power supply, and at least one pair of external electrical contacts arranged on said base unit and electrically connected with said power supply; and at least one light unit comprising at least one first pair of external electrical contacts, arranged on said light unit and arranged to mate with the at least one pair of electrical contacts of the base unit or another substantially identical unit, at least one second pair of external electrical contacts, arranged on said light unit and arranged to mate with the at least one first pair of electrical contacts of another substantially identical unit, and at least one LED lamp arranged on said light unit, said at least one first pair of external electrical contacts and said at least one second pair of external electrical contacts, and said lamp being electrically connected with each other.

21 Claims, 5 Drawing Sheets

MODULAR LAMP SYSTEM

CROSS REFERENCE TO RELATED APPLICATION

This application is the 35 U.S.C. §371 national stage of PCT application PCT/CN2008/001043, filed May 28, 2008, the disclosure of which is hereby incorporated by reference.

FIELD OF THE INVENTION

The invention relates to a modular lamp system.

BACKGROUND OF THE INVENTION

For each lighting market segment different fixtures are available in the market. Due to several reasons there are no possibilities to create your own fixture in the current lighting applications.

Currently fixture design by the end-user is not possible due to several design and manufacturing regulations like safety issues, etc. The current fixture design is a real complex technical design with a lot of regulation for example with respect to safety (insulation), temperature, etc. Therefore fixture design is only possible for technical specialists because for each lighting market segment regulations could be different.

One goal of the invention is to create a lamp system that is suitable for different lighting market segments with only one architecture. Another goal of the invention is that the user will be able to configure his own lamp system with ease and reconfigure the lamp system many times.

SUMMARY OF THE INVENTION

To that end the modular lamp system comprises a base unit comprising a power supply arranged for feeding lamps, and at least one pair of external electrical contacts arranged on a surface area of said base unit and electrically connected with said power supply; and at least one light unit comprising at least one first pair of external electrical contacts, arranged on a first surface area of said light unit and arranged to mate with the at least one pair of electrical contacts of the base unit or another substantially identical unit, at least one second pair of external electrical contacts, arranged on a second surface area of said light unit and arranged to mate with the at least one first pair of electrical contacts of another substantially identical unit, and at least one LED lamp arranged on a third surface area of said light unit, said at least one first pair of external electrical contacts and said at least one second pair of external electrical contacts, and said lamp being electrically connected with each other.

The term LED lamp is to be understood as an arrangement of one or more grouped LED-s or similar low-voltage light-emitting entities, such as OLED-s. By connecting the base unit and one or more light units with each other, each end-user can create and re-configure a LED light fixture design for different lighting applications and different lighting market segments. The user can choose a configuration of units in order to adapt the total light output and the position of the light beam(s).

Preferably the system further comprises connecting units comprising at least one first pair of external electrical contacts, arranged on a first surface area of said connecting unit and arranged to mate with the at least one pair of electrical contacts of the base unit or another substantially identical unit, and at least one second pair of external electrical contacts, arranged on a second surface area of said connecting unit and arranged to mate with the at least one first pair of electrical contacts of another substantially identical unit, said at least one first pair of external electrical contacts and said at least one second pair of external electrical contacts being electrically connected with each other. The connecting units provide greater flexibility to the user for building a desired lamp shape and position of the light beam.

In the preferred embodiment said base unit, said light unit and/or said connecting unit comprises light control means for adjusting light properties such as intensity, colour, colour temperature, direction and beam cone angle of the lamp. Said light control means preferably comprises a micro-controller. Said light control means may, in at least one unit, be arranged to receive control signals from an IR or RF remote control, or to detect user gestures for adjusting said light properties. Because the control means are provided in said units, the user may choose the kind of control that suits him best by choosing a suitable unit and placing it somewhere in the lamp system.

Said surfaces with said pairs of external electrical contacts of said light units and/or said connecting units further preferably comprise pairs of external communication contacts for communicating control signals with said light control means, each pair of external communication contacts in each unit being mutually electrically connected. In that manner the control functions can be performed in any of the units, and be communicated through the entire lamp system.

Said micro-controller in each unit is preferably arranged to fulfil both a master and a slave role, and said micro-controller in each unit is arranged to fulfil said master role only if the unit is mounted on the base unit, preferably if the unit is the first unit mounted on the base unit. Thereby it is possible to save power, because the slave units can be powered down while the master unit will stay active.

Said at least one first pair of external electrical contacts and said at least one second pair of external electrical contacts are preferably identical, and preferably are of the hermaphrodite type. In a preferred embodiment the contacts that are protruding are arranged such that they can be moved between a position under the surface area when they are not in use and a position where they protrude from said surface area for making contact with another unit. In an alternative embodiment said external electrical contacts are RF wireless power transmitters.

In a preferred embodiment said light unit and/or said connecting unit is substantially block, pyramid, prisma or cube shaped. Preferably substantially each side of said block or cube comprises one of said surface areas where one of said at least one pair of electrical contacts or one of said at least one lamp is arranged.

Preferably multiple electrical contacts are arranged on said at least one of said surface areas, such that the light unit and/or connecting unit can mate with another light unit or connecting unit or with the base unit in at least two different orientations, said orientations being rotated relative to each other around the central axis through said surface area. In the preferred embodiment one polar contact of said pair of electrical contacts on each surface area extends on the central axis of said surface area, and a multitude of opposite polar contacts comprising the other one of said pair of electrical contacts extend each at a different location at equal distance from said central axis.

The base unit and said at least one light unit are preferably provided with magnets arranged such that said units can be easily connected to each other by magnetic force.

The power supply may comprise a battery, or may be an AC mains powered supply comprising an AC/DC converter. Typically the lamp operates at a low DC power, such as 5.5 V.

BRIEF DESCRIPTION OF THE DRAWINGS

The invention will be further explained by means of preferred embodiments as shown in the accompanying drawings, wherein.

DETAILED DESCRIPTION OF THE PREFERRED EMBODIMENTS

Figure 1:
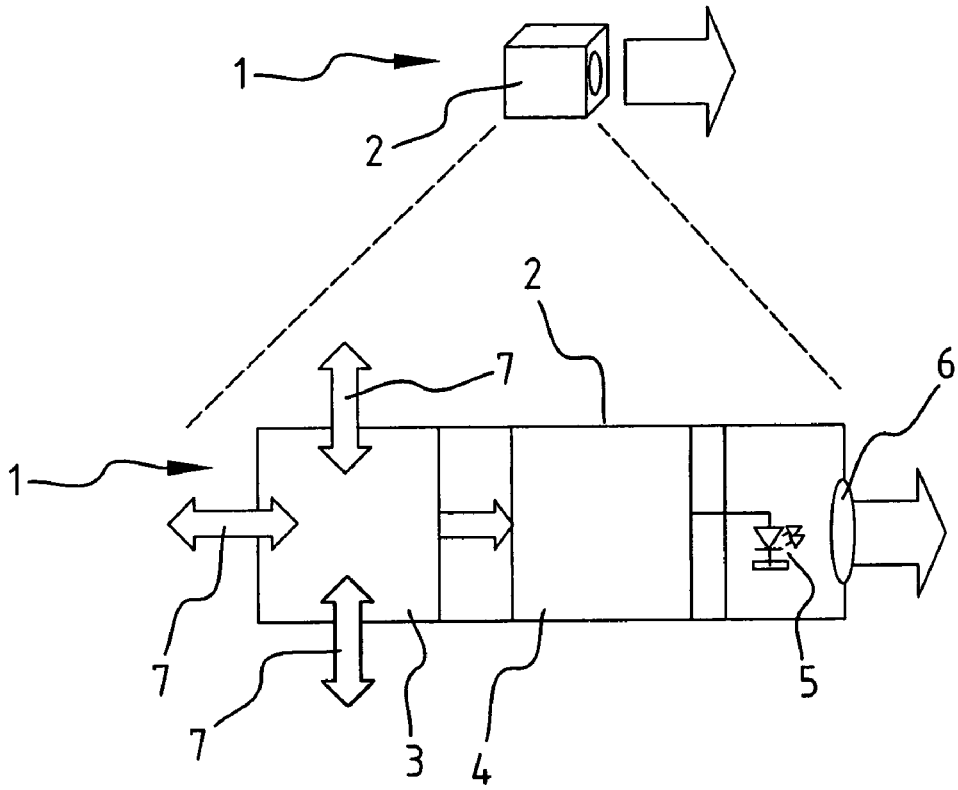
FIG. 1 schematically shows a light unit.

With reference to FIG. 1, each light unit 1 of the modular lamp system comprises a cube shaped housing 2, containing a micro-controller 3, a LED driver 4, and at least on LED 5 on one surface of said housing 2. A lens 6 may be present in front of the LED 5. Each light unit comprises power supply contacts and communication contacts (shown schematically in FIGS. 10 and 11) on the other surfaces of the housing. Communication connectors 7 between the different light units are provided for light control purposes (for instance dimming).

The housing 2 of the unit is made of metal. A low temperature of the LED-s increases their efficiency and lifetime, and therefore the metal housing 2 of each unit serves as a heat sink.

Figure 2:
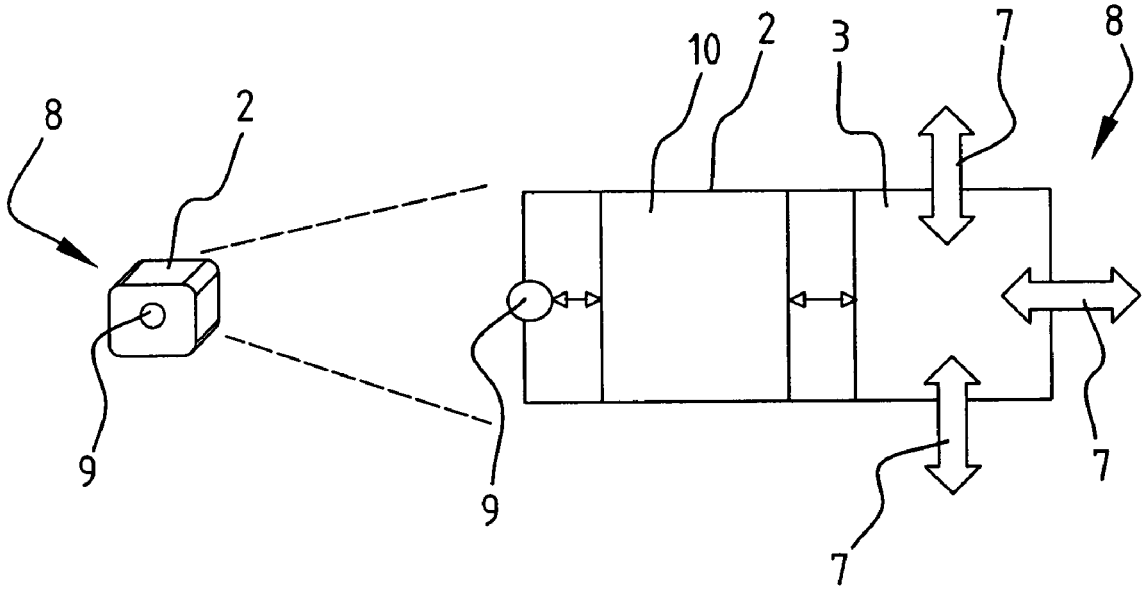
FIG. 2 schematically shows a connecting unit comprising control means for gesture control.

Other units with other functions like a user interface and external communication extend the system's functionality. Different user interfaces like a remote control (RC) receiver, voice control, and gesture control can be provided in special units. In FIG. 2 a gesture control unit 8 is shown comprising an ultrasound sensor 9, pre-processing means 10 and a micro-controller 3.

Figure 3:
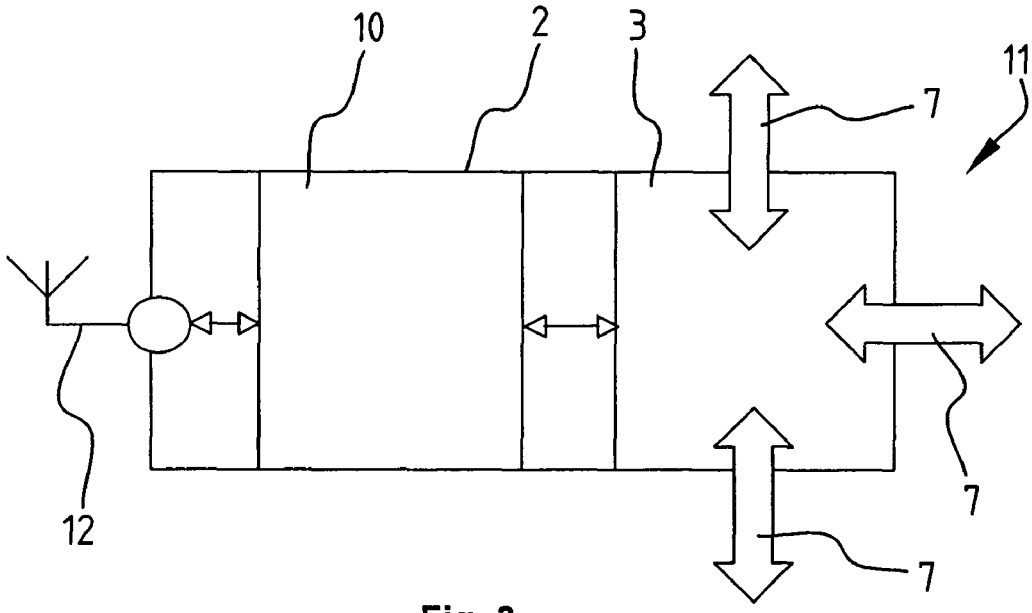
FIG. 3 schematically shows a connecting unit comprising control means for RF remote control.

Like the light unit, five of the six faces of the cubic gesture control unit 8 are provided with electrical and mechanical contacts. At the sixth side of the cubic unit the ultrasound sensor 9 is mounted. By moving an object (for instance a hand) in front of the sensor 9 light properties such as light intensity can be controlled by means of inter micro-controller communication between the micro-controller of the light unit 1 and the micro-controller of the gesture control unit 8. In FIG. 3 a similar RF wireless communication unit 11 is shown comprising an RF antenna 12 at one side of the cubic unit 11. Also communication between two separate modular systems is possible in this manner.

Figure 4:
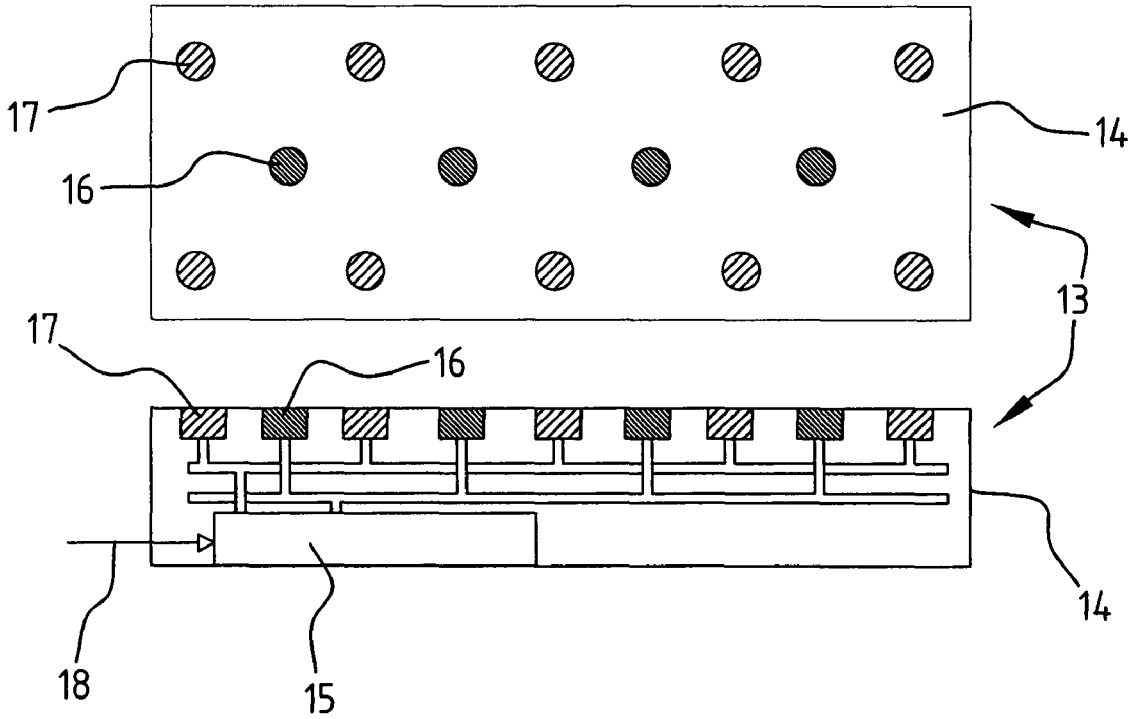
FIG. 4 schematically shows a base unit.

The basic unit 13 as shown in FIG. 4 comprises a metal plate shaped housing 14 and a power supply 15 with an AC/DC convertor for converting mains AC power 18 to a low DC voltage of 5.5 V. The metal plate may comprise permanent magnets (not shown) for connecting the other units to it, and electrical ground connectors 16 and low DC power connectors 17, which are arranged to mate with corresponding connectors of the other units 1, 8, 11.

Figure 5:
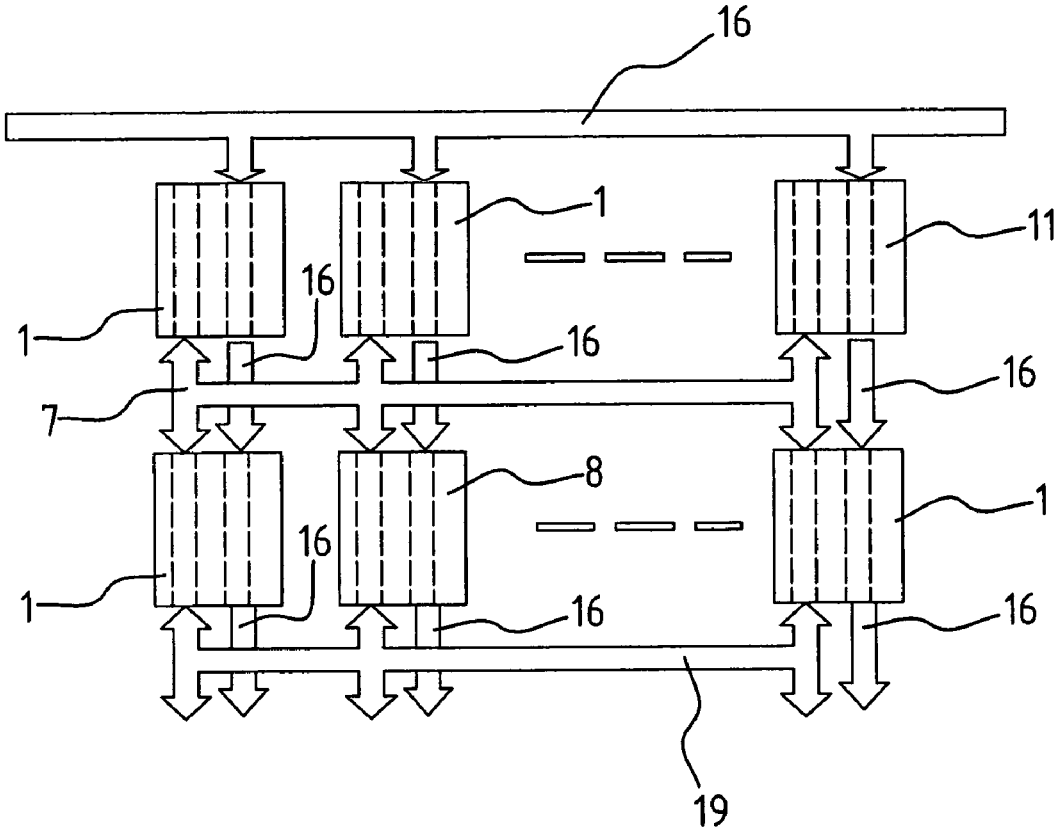
FIG. 5 schematically shows the connections between the units of the lamp system.

The units 1, 8, 11, 13 are arranged in accordance with FIG. 5 to communicate with each other via wire communication (transmitter/receiver or bus) lines 7 between the micro-controllers 3 in the units 1, 8, 11.

Figure 6:
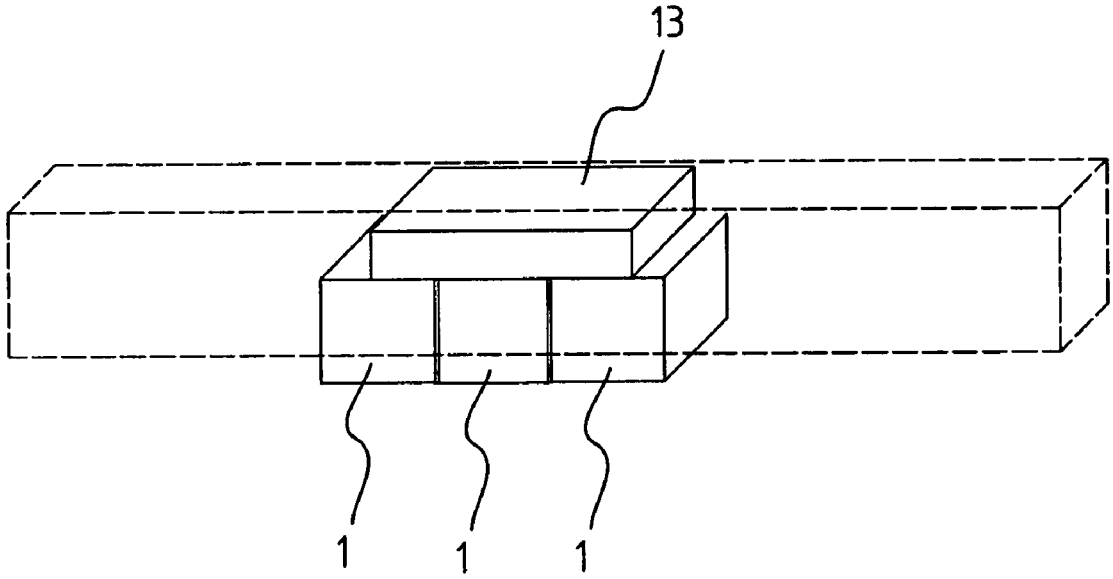
FIGS. 6-9 show in perspective view various embodiments of configurations of the lamp system.
Figure 7:
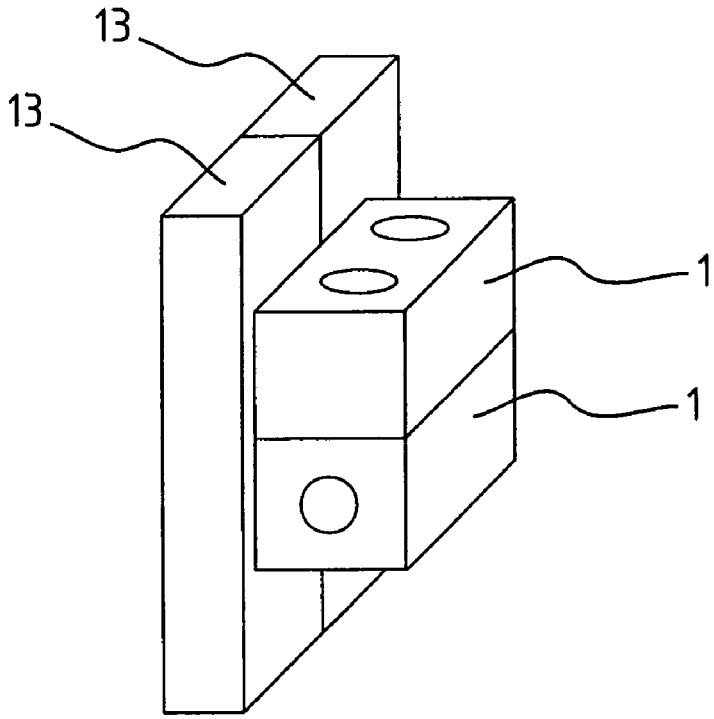
Figure 8:
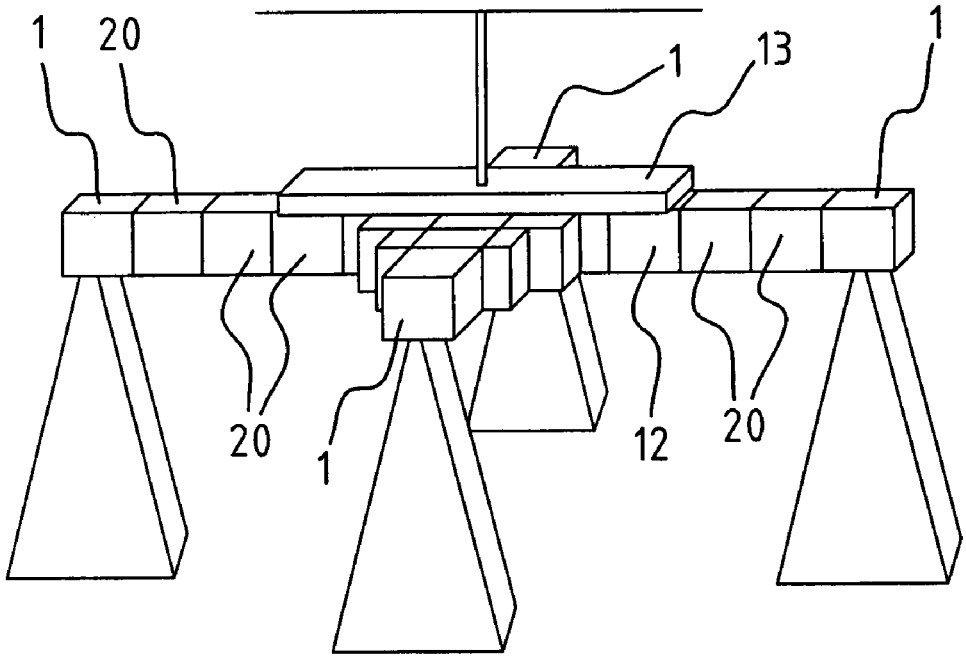
Figure 9:
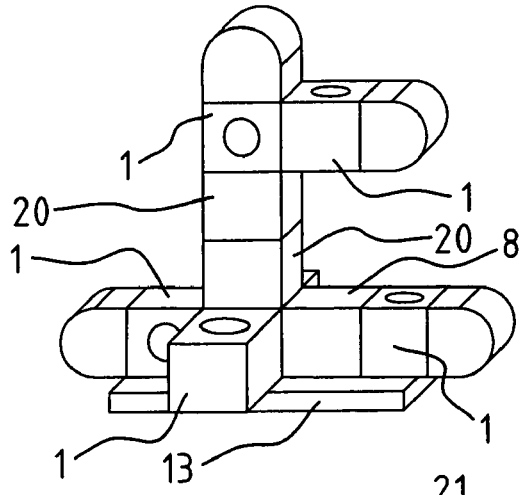
Figure 12:
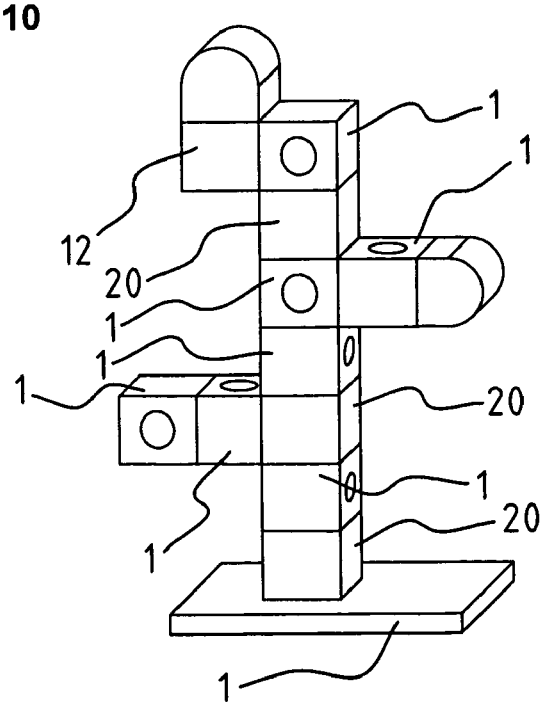
FIG. 12 shows in perspective view a further possible configuration of the lamp system.

Some examples of residential light applications are shown in FIG. 6 (an under-cabinet lamp), FIG. 7 (a decorative wall lamp), FIG. 8 (a down-light pendants fixture), and FIGS. 9 and 12 (table lamps). FIGS. 8, 9, 12 also show connecting units 20, which are basically identical to the light units, but they do not comprise driver 4, LED 5 nor microcontroller 3. Instead they have electrical connectors and communication connectors at the sixth face. The units are manually built together to a certain fixture design, and can be rebuilt together to obtain a different design.

Figure 10:
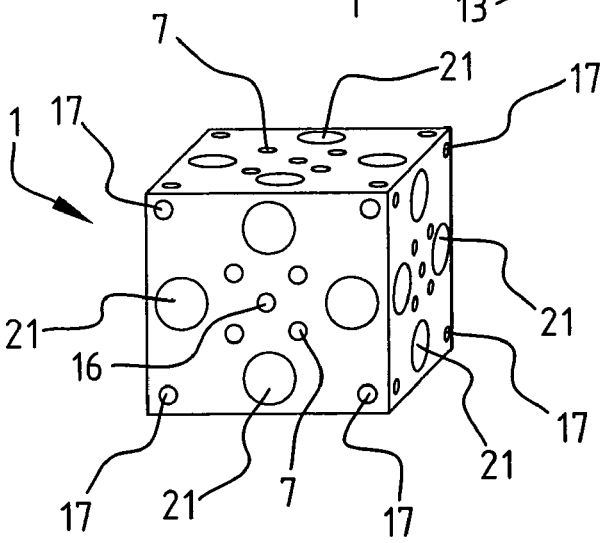
FIGS. 10 and 11 show in perspective view a cube shaped light unit.
Figure 11:
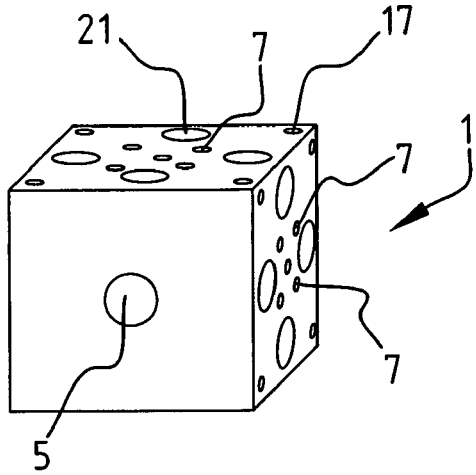

A cubic light unit 1 is shown in more detail in FIGS. 10 and 11. Five of the six sides of the light unit 1 have the same configuration with electrical connectors 16, 17 and communication connectors 7. The sixth side of the cubic light unit 1 comprises the LED 5.

The units 1, 8, 9 can be connected to each other at four different orientations, each rotated 90 degrees, which offers great flexibility for reconfiguration of the modular system.

Each of five of six cubic units 1, 8, 11, and all six sides of the cubic unit 20, are provided with permanent multi-pole magnets 21 and hermaphrodite electrical connectors 16, 17 and communication connectors 7 for Inter Micro-controller Communication. A low DC power supply connector 16 is located in the centre of the face and four ground connectors 17 are located near all four corners. The communication connectors 7 are located between the central connector 16 and each ground connector 17. The transmitter lines and the receiver lines connected to the connectors 17 are identical and reconfigurable in each micro-controller.

The first unit connected to the base unit 13 will be the master unit and all other units will be slave. One advantage of distinguishing between master and slave units is that power can be saved by powering down the slave blocks while the master block stays active.

In this embodiment electro-mechanical connections are described, but other electrical connections between two units are also possible, like wireless RF connections. RF wireless power transfer is possible due to the low power dissipation of LED light.

Although the invention is described herein by way of preferred embodiments as example, the man skilled in the art will appreciate that many modifications and variations are possible within the scope of the invention.

What is claimed is:

1. A modular lamp system, comprising:

a base unit comprising:

a power supply arranged for feeding lamps; and at least one pair of external electrical contacts arranged on a surface area of said base unit and electrically connected with said power supply; and at least one light unit comprising:

at least one first pair of external electrical contacts, arranged on a first surface area of said light unit and arranged to mate with the at least one pair of electrical contacts of the base unit or another substantially identical unit;

at least one second pair of external electrical contacts, arranged on a second surface area of said light unit and arranged to mate with the at least one first pair of electrical contacts of another substantially identical unit;

at least one LED lamp arranged on a third surface area of said light unit; and light control means for adjusting light properties;

said at least one first pair of external electrical contacts and said at least one second pair of external electrical contacts, and said lamp being electrically connected with each other;

wherein said surfaces of said light unit further comprise communication contacts and arranged to mate with said base unit or another substantially identical unit for communicating control signals.

2. The modular lamp system of claim 1, wherein the system further comprises sense units comprising:

at least one first pair of external contacts, arranged on a first surface area of said sense unit and arranged to mate with the at least one pair of electrical contacts of said base unit or said light unit or another substantially identical unit for power transmission;

a control means for processing sensing signals from a sensing interface; and external communication contacts arranged on said surfaces of said sense unit and arranged to mate with said surfaces of said other units or another substantially identical unit for communicating said control signals or said sensing signals.

3. The modular lamp system of claim 2, wherein the system further comprises connecting units comprising:

at least one first pair of external electrical contacts, arranged on a first surface area of said connecting unit and arranged to mate with the at least one pair of electrical contacts of the base unit or another substantially identical unit; and at least one second pair of external electrical contacts, arranged on a second surface area of said connecting unit and arranged to mate with the at least one first pair of electrical contacts of another substantially identical unit;

wherein said at least one first pair of external electrical contacts and said at least one second pair of external electrical contacts being electrically connected with each other;

wherein said surfaces of said connecting unit further comprise external communication contacts arranged to mate with said external communication contacts of said other unit or another substantially identical units for communicating said control signals or said sensing signals.

4. The modular lamp system of claim 1, wherein said light properties include at least one properties of intensity, colour, colour temperature, direction and beam cone angle of the lamp.

5. The modular lamp system of claim 1, wherein said external communication contacts in each unit are mutually electrically connected.

6. The modular lamp system of claim 1, wherein said light control means comprises a micro-controller.

7. The modular lamp system of claim 2, wherein said control means comprises a micro-controller.

8. The modular lamp system of claim 7, wherein said micro-controller in each unit is arranged to fulfill both a master and a slave role, and said micro-controller in each unit is arranged to fulfill said master role only if the unit is mounted on the base unit, preferably if the unit is the first unit mounted on the base unit.

9. The modular lamp system of claim 1, wherein said at least one first pair of external electrical contacts and said at least one second pair of external electrical contacts are identical.

10. The modular lamp system of claim 1, wherein said light unit, said sense unit and/or said connecting unit is substantially block, pyramid, prisma or cube shaped.

11. The modular lamp system of claim 10, wherein substantially each side of said block or cube comprises one of said surface areas where one of said at least one pair of electrical contacts or one of said at least one lamp is arranged.

12. The modular lamp system of claim 1, wherein multiple electrical contacts are arranged on said at least one of said surface areas, such that the light unit, the sense unit and/or connecting unit can mate with another light unit or sense unit or connecting unit or with the base unit in at least two different orientations, said orientations being rotated relative to each other around the central axis through said surface area.

13. The modular lamp system of claim 12, wherein one polar contact of said pair of electrical contacts on each surface area extends on the central axis of said surface area, and a multitude of opposite polar contacts comprising the other one of said pair of electrical contacts extend each at a different location at equal distance from said central axis.

14. The modular lamp system of claim 1, wherein said base unit and said at least one light unit are provided with magnets arranged such that said units can be connected to each other by magnetic force.

15. A modular lamp system, comprising:

a base unit having a power supply, and at least a first power supply contact electrically connected with said power supply;

at least a light unit having at least a second power supply contact, at least a first communication contact, a first micro-controller electrically connected with said first communication contact, and at least a LED lamp; and at least a sense unit having at least a third power supply contact, at least a second communication contact, and a second micro-controller electrically connected with said second communication contact;

wherein any two of said first power supply contact, said second power supply contact and said third power supply contact are mated with each other and are electrical connected so that electrical power is supplied to said light unit and said sense unit from said power supply;

wherein said first communication contact is mated and electrically connected with said second communication contact so that communication between said light unit and said sense unit is performed for controlling light properties of said light unit.

16. The modular lamp system of claim 15, wherein said sense unit further comprises a sensor interface.

17. The modular lamp system of claim 16, wherein said sensor interface is a ultrasound sensor or a RF antenna.

18. The modular lamp system of claim 15, wherein said sense unit further includes a pre-processing means for processing a signal received from said sensor interface, and said pre-processing means is electrically connected between said sensor interface and said second micro-controller.

19. The modular lamp system of claim 15, wherein the light properties includes at least one of intensity, color, color temperature, direction and beam cone angle of said LED lamp.

20. The modular lamp system of claim 15, wherein said light unit further includes a LED driver, which is electrically connected between said LED lamp and said first micro-controller.

21. The modular lamp system of claim 15, wherein said light unit and/or said sense unit is substantially block, pyramid or cube shaped.

* * * * *